US010718362B2

(12) United States Patent
Taira et al.

(10) Patent No.: US 10,718,362 B2
(45) Date of Patent: Jul. 21, 2020

(54) SYSTEMS AND METHODS FOR ACTIVELY CONTROLLING A VORTEX IN A FLUID

(71) Applicants: Florida State University Research Foundation, Inc., Tallahassee, FL (US); Ebara Corporation, Tokyo (JP)

(72) Inventors: Kunihiko Taira, Tallahassee, FL (US); Qiong Liu, Tallahassee, FL (US); Byungjin An, Fujisawa (JP); Motohiko Nohmi, Fujisawa (JP); Masashi Obuchi, Fujisawa (JP)

(73) Assignees: THE FLORIDA STATE UNIVERSITY RESEARCH FOUNDATION, INC., Tallahasee, FL (US); EBARA CORPORATION, Tokyo (JP)

( * ) Notice: Subject to any disclaimer, the term of this patent is extended or adjusted under 35 U.S.C. 154(b) by 70 days.

(21) Appl. No.: 16/185,752

(22) Filed: Nov. 9, 2018

(65) Prior Publication Data

US 2019/0145442 A1 May 16, 2019

Related U.S. Application Data

(60) Provisional application No. 62/583,538, filed on Nov. 9, 2017.

(51) Int. Cl.
*F15C 1/16* (2006.01)
*F15D 1/00* (2006.01)
(Continued)

(52) U.S. Cl.
CPC ..... *F15D 1/0015* (2013.01); *F04D 29/70* (2013.01); *F04D 29/708* (2013.01); *F15D 1/00* (2013.01);
(Continued)

(58) Field of Classification Search
CPC ..... F15D 1/0015; F15D 1/00; F15D 1/001; F15D 1/008; F15D 1/0095; F15D 1/04; F15D 1/12; F04D 29/70; F04D 29/708
(Continued)

(56) References Cited

U.S. PATENT DOCUMENTS 3,186,513 A * 6/1965 Dunn ..... F16J 15/40 184/109
3,208,463 A * 9/1965 Hyman ..... F15C 1/00 137/808
(Continued)

FOREIGN PATENT DOCUMENTS

DE 3811768 A1 * 10/1989 ..... B01F 3/04531
JP S6067798 A 4/1985
(Continued)

OTHER PUBLICATIONS

International Search Report and Written Opinion, PCT/US2018/059980, dated Feb. 18, 2019 (18 pp.).
(Continued)

*Primary Examiner* — Minh Q Le
(74) *Attorney, Agent, or Firm* — Eversheds Sutherland (US) LLP

(57) ABSTRACT

A vortex control device for modifying a vortex in a fluid stemming from a wall is disclosed. The device includes a rotatable hub disposed within an opening in the wall. The device also includes an inlet port and an outlet port in the rotatable hub. The inlet port forms a suction port to suction fluid from or about the vortex, and the outlet port forms an injection port to inject fluid into or about the vortex.

19 Claims, 14 Drawing Sheets

(51) Int. Cl.
*F04D 29/70* (2006.01)
*F15D 1/04* (2006.01)

(52) U.S. Cl.
CPC ..... *F15D 1/001* (2013.01); *F15D 1/008* (2013.01); *F15D 1/0095* (2013.01); *F15D 1/04* (2013.01)

(58) Field of Classification Search
USPC ..... 137/808; 244/205, 199.1, 200.1, 201, 244/203, 204
See application file for complete search history.

(56) References Cited

U.S. PATENT DOCUMENTS

| | | | | |
|---|---|---|---|---|
| 4,206,783 | A * | 6/1980 | Brombach | E03F 5/106 137/808 |
| 4,429,843 | A | 2/1984 | Thompson | |
| 4,452,562 | A * | 6/1984 | Hsu | F03D 1/04 415/208.1 |
| 4,696,442 | A | 9/1987 | Mazzitelli | |
| 5,435,283 | A | 7/1995 | Zehr | |
| 5,544,524 | A | 8/1996 | Huyer et al. | |
| 5,758,823 | A | 6/1998 | Glezer et al. | |
| 5,971,327 | A * | 10/1999 | Loth | B64C 23/04 244/204 |
| 5,971,765 | A * | 10/1999 | Gill | G09B 23/12 434/217 |
| 6,119,987 | A | 9/2000 | Kiknadze et al. | |
| 7,108,457 | B1 | 9/2006 | Brown et al. | |
| 7,686,257 | B2 | 3/2010 | Saddoughi et al. | |
| 7,967,258 | B2 | 6/2011 | Smith et al. | |
| 8,517,053 | B2 * | 8/2013 | Henry | F15D 1/00 137/545 |
| 2008/0149205 | A1 | 6/2008 | Gupta et al. | |
| 2009/0050801 | A1 * | 2/2009 | Fedorov | H01J 49/066 250/288 |
| 2010/0243819 | A1 | 9/2010 | Stanislas et al. | |
| 2013/0104786 | A1 | 5/2013 | Brummer | |
| 2013/0327727 | A1 * | 12/2013 | Hopper | B04C 5/103 210/787 |
| 2014/0298991 | A1 * | 10/2014 | Stapleton | B01D 19/0057 95/46 |
| 2015/0068629 | A1 * | 3/2015 | Kottilingam | B22F 3/1055 137/808 |
| 2015/0224517 | A1 * | 8/2015 | Ramalingam | B01D 21/0012 210/85 |
| 2015/0268667 | A1 * | 9/2015 | Jarman | E03F 5/106 137/10 |
| 2015/0292533 | A1 * | 10/2015 | Roy | F15D 1/12 137/13 |
| 2016/0061234 | A1 * | 3/2016 | Doll | F15D 1/0005 137/808 |
| 2016/0318602 | A1 | 11/2016 | Whalen et al. | |
| 2019/0136881 | A1 * | 5/2019 | Amitay | F15D 1/12 |

FOREIGN PATENT DOCUMENTS

| | | |
|---|---|---|
| JP | 2006194100 A | 7/2006 |
| JP | 2017036717 A | 2/2017 |

OTHER PUBLICATIONS

Gad-El-Hak, M. and Bushnell, D. M., "Separation Control: Review," J. Fluids Eng., vol. 113, No. 5, pp. 5-30, Published Mar. 1991 (26 pages).
Greenblatt, D. and Wygnanski, I., The control of flow separation by periodic excitation, Progress in Aerospace Sciences, vol. 36, pp. 487-545, published 2000 (59 pages).
Cattafesta, L. et al., Review of Active Control of Flow-Induced Cavity Oscillations, Progress in Aerospace Sciences, vol. 44, pp. 479-502, published 2008 (24 pages).
Caattafesta, L. N. and Sheplak, M., Actuators for Active Flow Control, Annual Rev. of Fluid Mech., vol. 43, pp. 247-272, published 2011 (28 pages).
Wu et al., Post-stall flow control on an airfoil by local unsteady forcing, J. Fluid Mech., vol. 371, pp. 21-58, published 1998 (38 pages).
Glezer, A. and Amitay, M., Synthetic Jets, Annual Rev. of Fluid Mech., vol. 3, pp. 503-529, published 2002 (31 pages).
Corke, T. C. et al., Dielectric Barrier Discharge Plasma Actuators for Flow Control, Annual Rev. of Fluid Mechanics, vol. 42, pp. 505-529, published 2010 (27 pages).
Compton, D. A. and Johnston, J. P., Streamwise Vortex Production by Pitched and Skewed Jets in a Turbulent Boundary Layer, AIAA Journal, vol. 30, pp. 640-647, published Mar. 1992 (8 pages).
Selby et al., "Control of low-speed turbulent separated flow using jet vortex generators," Experiments in Fluids, vol. 12, pp. 394-400, published 1992 (7 pages).
Zhang, X., "The evolution of co-rotating vortices in a canonical boundary layer with inclined jets," Physics of Fluids, vol. 15, No. 12, pp. 3693-3702, published Dec. 2003 (11 pages).
Pedro, H. T. C. and Kobayashi, M. H., "Numerical study of stall delay on humpback whale flippers," AIAA Paper 2008-0584, pp. 1-8, published 2008 (8 pages).
Kerho et al., "Vortex generators used to control laminar separation bubbles," J. Aircraft, vol. 30, No. 3, pp. 315-319, published May-Jun. 1992 (5 pages).
Lin, J. C., "Review of research on low-profile vortex generators to control boundary-layer separation," Progress in Aerospace Science, vol. 3, pp. 389-420, published 2002 (32 pages).
Bechert et al., "Biological surfaces and their technological application—Laboratory and Flight Experiments on Drag Reduction and Separation Control," AIAA Paper 1997-1960, pp. 1-34, published 1997 (35 pages).
Choi et al., "Direct numerical simulation of turbulent flow over riblets," J. of Fluid Mech., vol. 255, pp. 503-539, published 1993 (39 pages).
Gaster, M., "On the generation of spatially growing waves in a boundary layer," J. of Fluid Mech., vol. 22, pp. 433-441, published 1965 (9 pages).
Liepmann et al., "Control of laminar-instability waves using a new technique," J. of Fluid Mech., vol. 118, pp. 187-200, published 1982 (14 pages).
Goldstein et al., "Direct numerical simulation of turbulent flow over a modelled riblet covered surface," J. of Fluid Mech., vol. 302, pp. 333-376, published 1995 (47 pages).
Kim, J., "Control of turbulent boundary layers," J. of Fluid Mech., vol. 15, No. 5, pp. 1093-1105, published May 2003 (14 pages).
Kravchenko et al., "On the relation of near-wall streamwise vortices to wall skin friction in turbulent boundary layers," Physics of Fluids, vol. 5, pp. 3307-3309, published 1993 (4 pages).
Schubaur, G. B. and Spangenberg, "Forced mixing boundary layers," J. of Fluid Mech., vol. 8, pp. 10-32, published 1960 (25 pages).
Liepmann, H. W. and Nosenchuck, D. M., "Active control of laminar-turbulent transition," J. of Fluid Mech., vol. 118, pp. 201-204, published 1982 (4 pages).
Shakaba et al., "Longitudinal vortices imbedded in turbulent boundary layer. Part 1. Single vortex," J. of Fluid Mech., vol. 155, pp. 37-57, published 1985 (21 pages).
Morinishi et al., "Fully conservative high order finite difference schemes for incompressible flow," J. of Computational Physics, vol. 143, pp. 90-124, published 1998 (35 pages).
Vreman, A. W., "An eddy-viscosity subgrid-scale model for turbulent shear flow: algebraic theory and applications," Physics of Fluids, vol. 16, pp. 3670-3681, published 2004 (12 pages).
Germano et al., "A dynamic subgrid-scale eddy viscosity model," Physics of Fluids, vol. 3, No. 7, pp. 1760-1765, published 1991 (6 pages).
Kim, J. and Moin, P., "Application of a fractional-step method to incompressible Navier-Stokes equations," J. of Computational Physics, vol. 59, pp. 308-323, published 1985 (16 pages).
Kojima et al., "Large-eddy simulation of low-Reynolds-number flow over thick and thin NACA airfoils," J. of Aircraft, vol. 50, No. 1, pp. 187-196, published 2013 (10 pages).

(56) References Cited

OTHER PUBLICATIONS

Seifert, A. and Pack, L. T., "Oscillatory excitation of unsteady compressible flows over airfoils at flight Reynolds numbers," AIAA, No. 10.2514/6.1999-925, published 1999 (16 pages).
Gilarranz et al., "A new class of synthetic jet actuators—Part II: application to flow separation control," J. of Fluids Eng., vol. 127, published Mar. 2005 (11 pages).
Deng et al., "DNS for flow separation control around an airfoil by pulsed jets," Computers and Fluids, vol. 36, No. 6, pp. 1040-1060, published 2007 (21 pages).
You et al., "Discrete conservation principles in large-eddy simulation with application to separation control over an airfoil," Physics of Fluids, vol. 20, published Oct. 2008 (12 pages).
International Search Report for PCT/USI5/17945 filed on Feb. 27, 2015 dated Nov. 24, 2015 (6 pages).
Ham et al., "Energy Conservation in collocated discretization schemes on unstructured meshes," Center for Turbulence Research Annual Research Briefs, pp. 3-14, published 2004 (12 pages).
Ham et al., "Accurate and stable finite volume operators for unstructured flow solvers," Center for Turbulence Research Annual Research Briefs, pp. 243-261, published 2006 (19 pages).
Information Disclosure Statement for U.S. Appl. No. 15/925,991, filed Apr. 19, 2018 (7 pages).
Information Disclosure Statement for U.S. Appl. No. 15/250,330, filed Sep. 22, 2016 (4 pages).
Information Disclosure Statement for U.S. Appl. No. 15/250,330, filed Oct. 13, 2016 (7 pages).

* cited by examiner

Vorticity Magnitude Visualization ω=2
(Shaded by Instantaneous Pressure)

SYSTEMS AND METHODS FOR ACTIVELY CONTROLLING A VORTEX IN A FLUID

CROSS-REFERENCE TO RELATED APPLICATIONS

The disclosure claims priority to and the benefit of U.S. provisional patent application No. 62/583,538, filed Nov. 9, 2017, which is incorporated by reference herein in its entirety.

FIELD OF THE DISCLOSURE

The disclosure generally relates to vortices and more particularly relates to systems and methods for actively controlling a vortex in a fluid.

BACKGROUND

Wall-bounded vortex arises in both nature and various engineering applications. There have been efforts to understand the dynamics of vortices and to develop techniques to modify their behavior. Flow control is often employed to diminish the appearance of vortices or alter the characteristics of vortices in a liquid. For example, in a sump pump, the emergence of submerged vortices may degrade pump performance. If the submerged vortices are sufficiently strong, these vortices can include strong low-pressure cores, which can entrain air/vapor along their vortex cores. If such hollow-core vortices are engulfed by the pump, they can cause unbalanced loading and vibration, leading to undesirable noise and possible structural failure. Strong wall-normal vortices appear inside and outside of many fluid-based machines as well as in natural settings, including tornadoes and hurricanes.

There have been numerous attempts to introduce passive vortex control techniques to prevent the generation of the aforementioned vortices or alter their pressure distributions. Yet passive control techniques do not offer the ability to adaptively adjust the control efforts to unsteady flow conditions (beyond design conditions). Moreover, some passive control devices are difficult to manufacture. Thus, these past efforts have shortcomings in offering reliable techniques to modify the pressure distribution of these vortices. Designing a more efficient and flexible vortex control strategy remains a challenge.

SUMMARY

In certain embodiments, a vortex control device for modifying a vortex in a fluid stemming from a wall is disclosed. The device includes a rotatable hub disposed within an opening in the wall. The device also includes an inlet port and an outlet port in the rotatable hub. The inlet port forms a suction port to suction fluid from or about the vortex, and the outlet port forms an injection port to inject fluid into or about the vortex. The device may therefore alter a pressure distribution of the vortex by injecting momentum perturbations to the flow.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
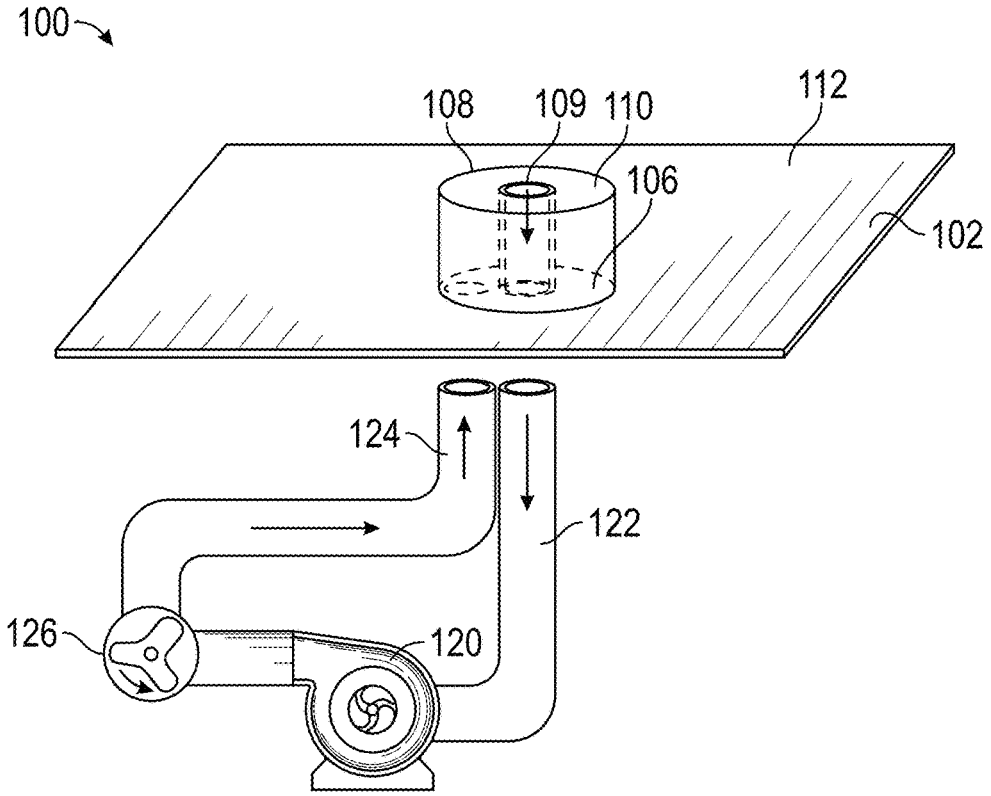
FIG. 1 depicts a vortex control device in accordance with one or more embodiments of the disclosure.

The present disclosure is directed to spreading the core region of a coherent wall-normal vortex and alleviating the low-pressure in the core in a flow field. Such vortices are ubiquitous in nature and engineering systems, ranging from hydrodynamic/aerospace applications to nature, such as hurricanes and subsurface vortices. Many passive control techniques exist for wall-normal vortices, but none include active flow control methods that can be applied in an adaptive manner. To solve this problem, the present disclosure introduces a control device comprising forcing input (e.g., a fluid jet and suction) at or near the core region of the vortex to destabilize the local flow and spread the core region. The injected fluid modifies the dynamics of the vertical flow and lowers the local angular velocity, increasing the core pressure of the vortex. The increase of the pressure has engineering benefits because low pressure at the core can create detrimental engineering effects for vortices in air and liquids. In some instances, the forced input follows a sinusoidal form in time and in a co-rotating/counter-rotating direction for effective breakup of the vortex.

The present disclosure provides a more adaptive technique than passive controls for alleviating the low-pressure effect of the vortex core using active flow control techniques. That is, the present disclosure provides a vortex control technique and device for control of vortices stemming from the wall in different flow conditions. To achieve this, two different types of control strategies are disclosed based on co-rotating and counter-rotating mass injection and suction from the wall surface on which the vortex resides. The control strategy is employed on the wall where the vortex core is positioned and the mass injection/suction device is placed underneath the surface. The control device may be centered or off-centered from the core of the vortex. The control input is adjusted with its frequency, amplitude, and direction of mass injection/suction. The control device may draw fluid from the system that the vortex is formed and inject said fluid back into the system. That is, the same fluid in which the vortex is formed may be injected/suctioned at or about the vortex. In other instances, the control device may inject fluid from outside the system into the vortex. In some instances, injection/suction is introduced from multiple locations in a rotational manner with respect to the vortex core. These devices allow the control input to be tuned for vortices with different strengths.

Vortex Control Device

FIGS. 1-4 and 15 depict examples of a vortex control device 100. The vortex control device 100 may be disposed at or below a wall plate 102 to which a vortex 104 is pinned. The vortex 104 may be formed in a fluid. The fluid may be a liquid or a gas. In some instances, a plurality of vortex control devices 100 may be used. That is, two, three, or more of the vortex control devices 100 may be disposed at various locations about the wall plate 102 around the vortex 104.

In certain embodiments, the vortex control device 100 includes a hub 106. The hub 106 may be disposed within an opening 108 in the wall plate 102. In some instances, the hub 106 includes a surface 110 that is flush with a surface 112 of the wall plate 102. In other instances, the surface 110 of the hub 106 may not be flush with the wall plate 102. That is, the surface 110 of the hub 106 may be recessed within the wall plate 102, or the surface 110 of the hub 106 may protrude out from the wall plate 102. The hub 106 may be any suitable size, shape, or configuration. The hub 106 may act as a stationary or rotating manifold for the vortex control device 100.

In certain embodiments, as depicted in FIG. 1, the hub 106 is stationary. That is, the hub 106 may not rotate. In such instances, the hub 106 may include a port 109. The port 109 may be fixed in place and act as an inlet port (suction port) or an outlet port (injection port) depending its attachment to a pump and the control device configuration. In some instances, the port 109 is located at or near a core of the vortex 104. In other instances, the port 109 is disposed around a perimeter of the vortex 104. The port 109 may be located in any suitable location at or about the vortex 104. The number of ports 109 may be increased. That is, a number of ports 109 may be located at or about the vortex 104. In some instances, the ports 109 may all be suction ports. In other instances, the ports 109 may all be injection ports. In yet other instances, some of the ports 109 may function as injection ports while other ports 109 function as suction ports. In some instances, the ports 109 may be operated simultaneously. In other instances, the ports 109 may be selectively operated. That is, some ports 109 may be turned "on" while other are turned "off" at certain, potentially variable, times.

The angle of the port 109 may be controlled (e.g., tilted or the like) to further modify the vortex 104. For example, the blow or suction angle of the port 109 may be adjusted relative to the surface 110 of the hub 106. In other instances, the hub 106 itself may be manipulated (e.g., tilted) so as to adjust the blow and/or suction angles.

In one embodiment, the vortex control device 100 includes a pump 120 in fluid communication with the hub 106. In some instances, the pump may be in fluid communication with two conduits. For example, a first conduit 122 can be fluidly coupled to the port 109 such that the port 109 functions as a suction port. In other instances, the port 109 can be fluidly coupled to a second conduit 124 such that the port 109 functions as an injection port. The vortex control device 100 also may include a valve 126 to control the mass flow of the vortex control device 100. In this particular embodiment, the valve 126 is a rotary valve. However, any suitable valve 126 may be used. In other instances, the mass flow may be controlled via an inverter to control the pump speed.

As used herein, the term "fluidly couples" refers to the coupled parts being operably connected together and effective for a fluid to be communicated therebetween.

Figure 2:
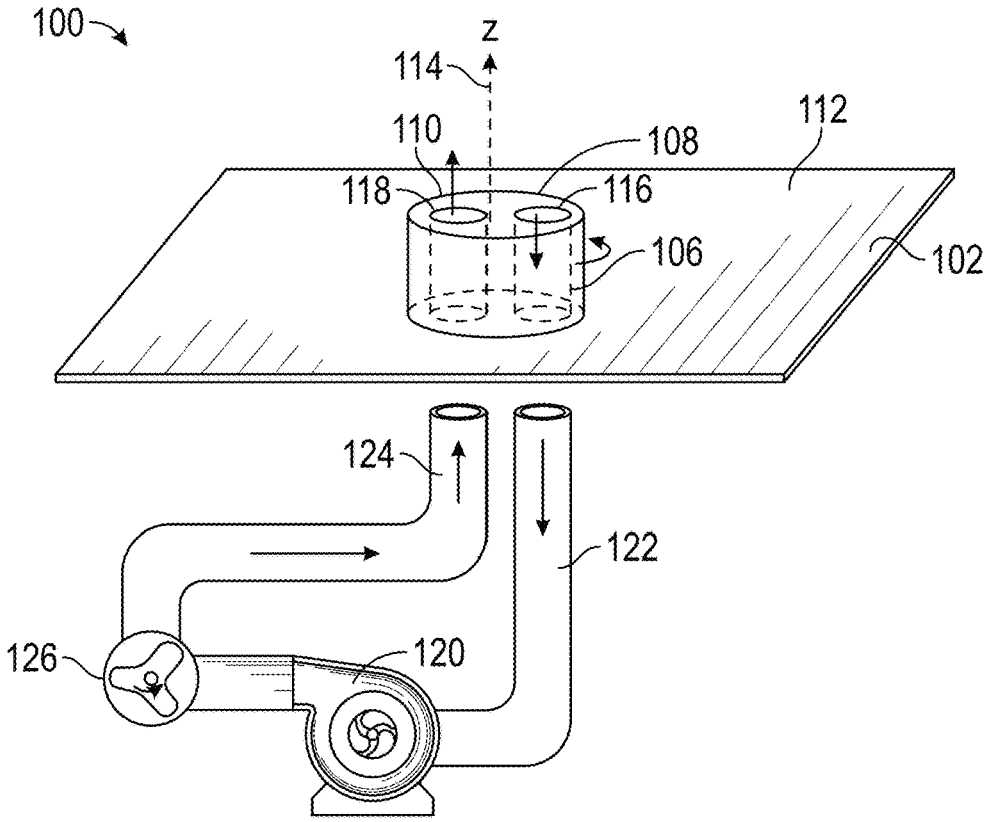
FIG. 2 depicts a vortex control device in accordance with one or more embodiments of the disclosure.
Figure 3:
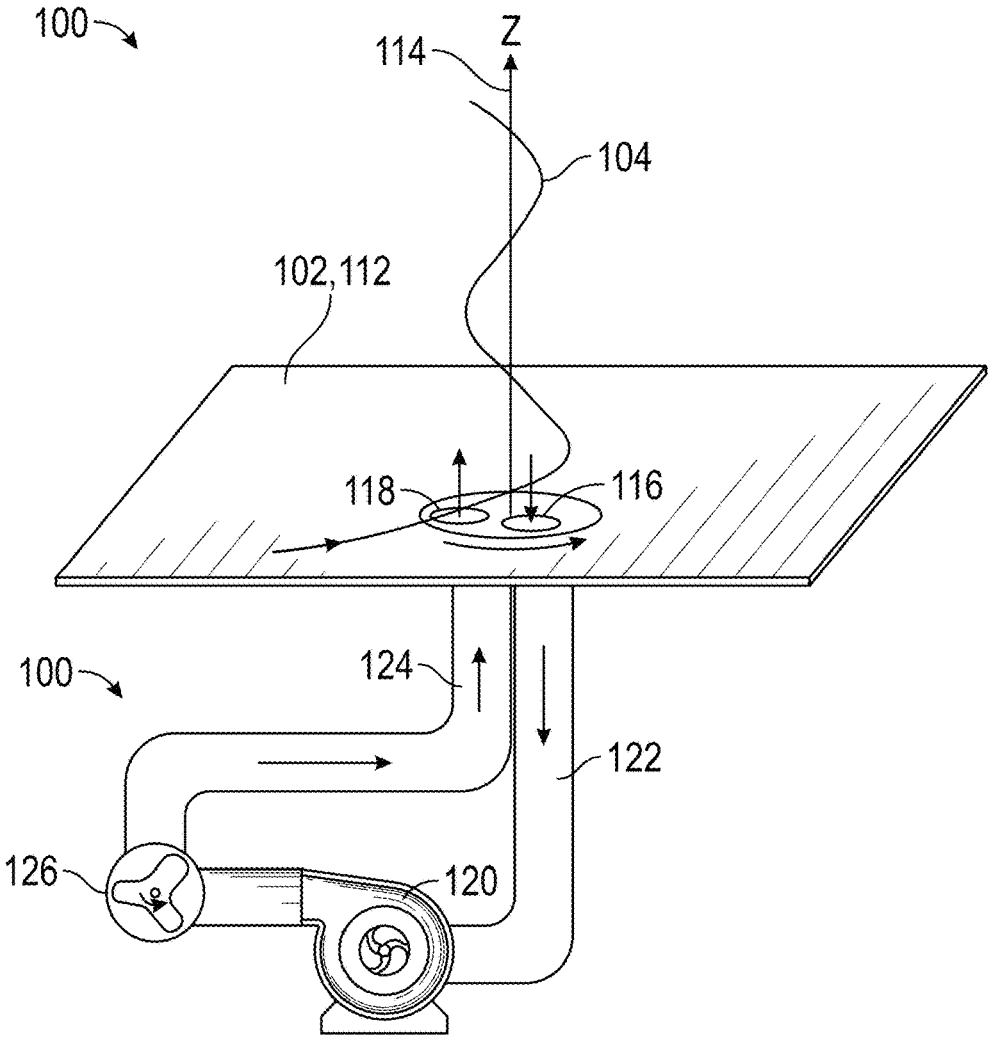
FIG. 3 depicts a vortex control device in accordance with one or more embodiments of the disclosure.
Figure 4:
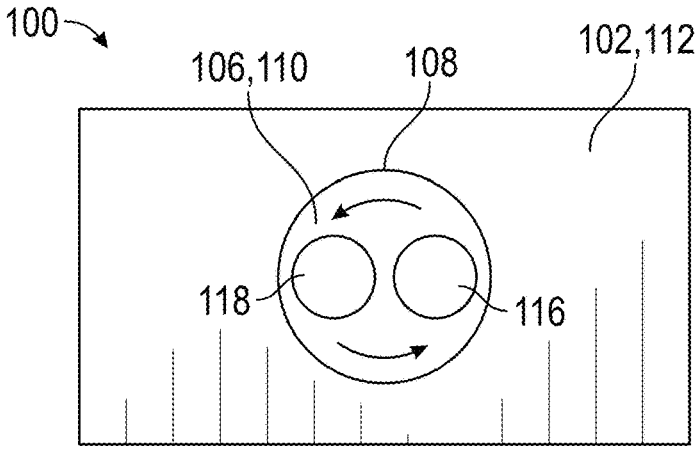
FIG. 4 depicts a vortex control device in accordance with one or more embodiments of the disclosure.

In other instances, as depicted in FIGS. 2-4, the hub 106 rotates about a central axis 114. In such instances, the hub 106 can rotate in either direction (i.e., clockwise or counterclockwise). Depending on the rotation of the vortex 104, the hub 106 may rotate with the vortex 104 (i.e., co-rotate) or rotate opposite the vortex 104 (i.e., counter-rotate).

In some instances, the hub 106 includes an inlet port 116 and an outlet port 118. The inlet port 116 may form a suction port, and the outlet port 118 may form an injection port. In some instances, the inlet port 116 and the outlet port 118 are located at or near a core of the vortex 104. In other instances, the inlet port 116 and the outlet port 118 are disposed around a perimeter of the vortex 104. The inlet port 116 and the outlet port 118 may be located in any suitable location about the vortex 104. In some instances, the vortex control device 100 may include a plurality of the number of inlet ports 116 and outlet ports 118. When a plurality of inlet ports 116 and outlet ports 118 are present, the inlet ports 116 and outlet ports 118 may be operated simultaneously. In other instances, the inlet ports 116 and outlet ports 118 may be selectively operated, such as in a predetermined sequence, e.g., serially. That is, some the inlet ports 116 and outlet ports 118 may be turned "on" while other are turned "off" at various times.

In any case, fluid, e.g., a liquid, may be drawn into the inlet port 116 and expelled out of the outlet port 118. As the hub 106 rotates within the wall plate 102, the location of the inlet port 116 and the outlet port 118 may rotate about the central axis 114. In some instances, the core of the vortex may be aligned with the central axis 114. In other instances, the core of the vortex may be offset from the central axis 114. To modify the vortex 104, the outlet port 118 is used to inject fluid, e.g., a liquid, into or about the vortex 104, and the inlet port 116 is used to suction fluid from or about the vortex 104. The inlet port 116 and the outlet port 118 may be operated simultaneously. That is, the inlet port 116 may suction fluid from or about the vortex 104 at the same time that the outlet port 118 injects fluid into or about the vortex 104. In other instances, the inlet port 116 and the outlet port 118 may not operate simultaneously. That is, only one of the inlet port 116 and the outlet port 118 may operate at once.

In certain embodiments, the angle of the inlet port 116 and the outlet port 118 may be controlled (e.g., tilted or the like) to further modify the vortex 104. For example, the blow angle of the outlet port 118 may be adjusted relative to the surface 110 of the hub 106. Similarly, the suction angle of the inlet port 116 may be adjusted relative to the surface 110 of the hub 106. In other instances, the hub 106 itself may be manipulated (e.g., tilted) so as to adjust the blow and/or suction angles.

In one embodiment, the vortex control device 100 includes a pump 120 in fluid communication with the hub 106. For example, a first conduit 122 fluidly couples the inlet port 116 to the pump 120, and a second conduit 124 fluidly couples the outlet port 118 to the pump 120. The vortex control devices 100 also may include a valve 126 to control the mass flow of the vortex control device 100. In this particular embodiment, the valve 126 is a rotary valve. However, any suitable valve 126 may be used. In other instances, the mass flow may be controlled via an inverter to control the pump speed.

Figure 15:
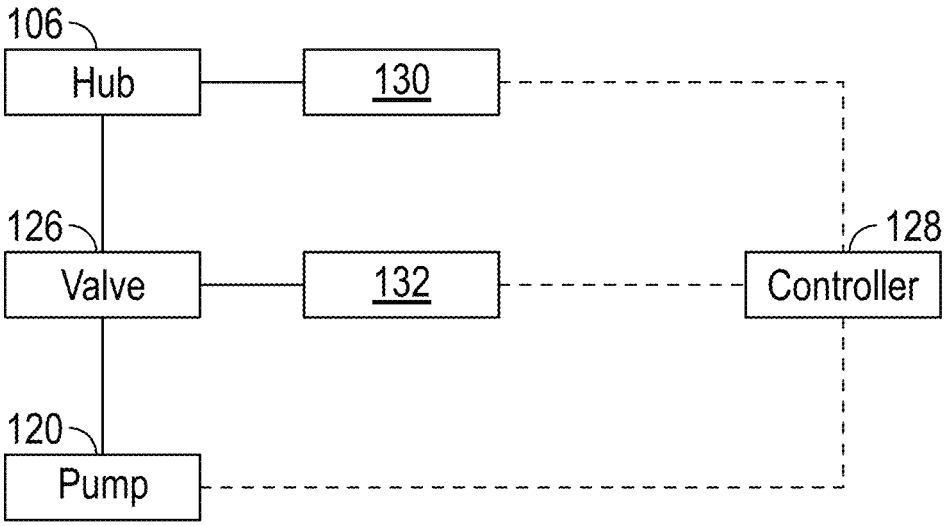
FIG. 15 depicts a vortex control device in accordance with one or more embodiments of the disclosure.

As depicted in FIG. 15, the vortex control device 100 may include a controller 128 in electrical communication with the various components of the vortex control device 100. The controller 128 may be any computing device capable of controlling the operation of the vortex control device 100. The controller 128 may include one or more processors in communication with one or more memory. In some instances, the controller 128 may include wireless communication capabilities. That is, the controller 128 may wirelessly communicate with the various components of the vortex control device 100 or other outside devices, such as a computer or server.

The controller 128 may be in communication with at least one hub actuator 130, which may be in electrical and/or mechanical communication with the hub 106. In this manner, the hub actuator 130 may be configured to control the movement of the hub 106. For example, the hub actuator 130 may control the rotation or tilt of the hub 106 or the ports associated therewith. The controller 128 also may be in communication with at least one valve actuator 132, which may be in electrical and/or mechanical communication with the valve 126. In this manner, the valve actuator 132 may be configured to control the operation of the valve 126. In addition, the controller 128 may be in communication with the pump 120. In this manner, the controller 128 may be configured to control the operation of the pump 120.

Vortex Model

Figure 5:
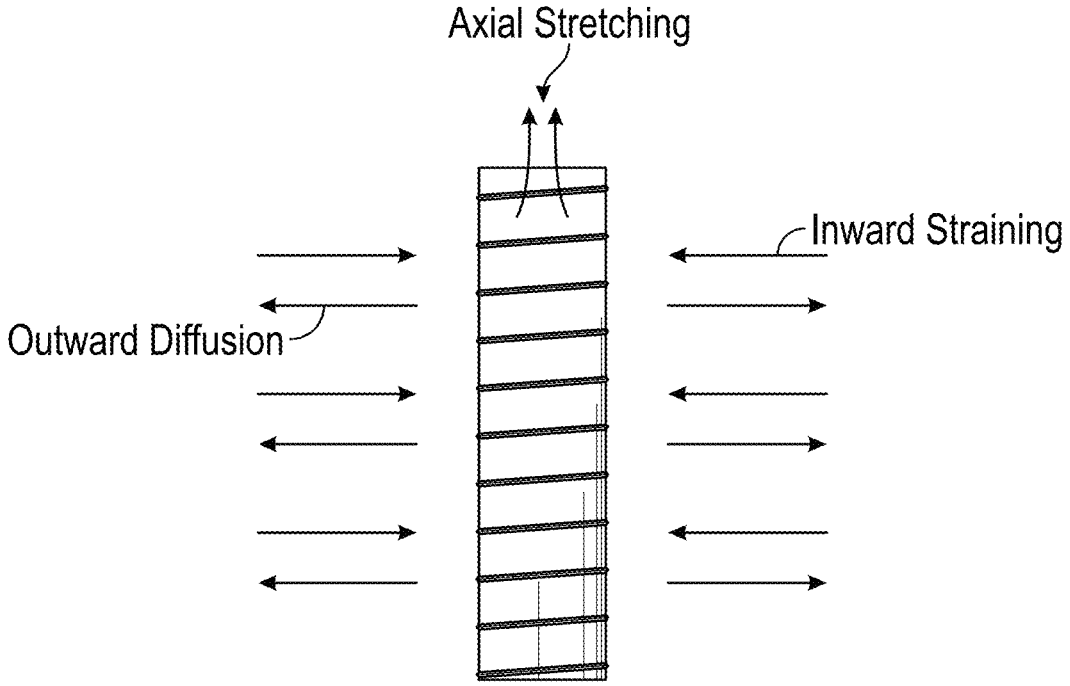
FIG. 5 depicts a vortex model based on Burgers vortex in accordance with one or more embodiments of the disclosure.

Extensive numerical simulation and experimental investigations were performed on a vortex control device. For example, FIG. 5 depicts a vortex model using Burgers vortex. Burgers vortex is an axis symmetric vortex subjected to an axial strain field of constant strain rate γ. The velocity field is expressed in cyclical coordinates (r, θ, z) as $$u_r = -\frac{1}{2}\gamma r,\ u_g = \frac{\Gamma}{2\pi r}\left[1-\exp\left(-\frac{r^2}{a_0^2}\right)\right],\ u_z = \gamma z,\ \text{and}\ a_0^2 = \frac{4\nu}{\gamma},$$

where vortex core size $a_0$=1, circulation: Γ=9.848, $u_\theta$, max=1, and Re=Γ/ν=5000.

Figure 6:
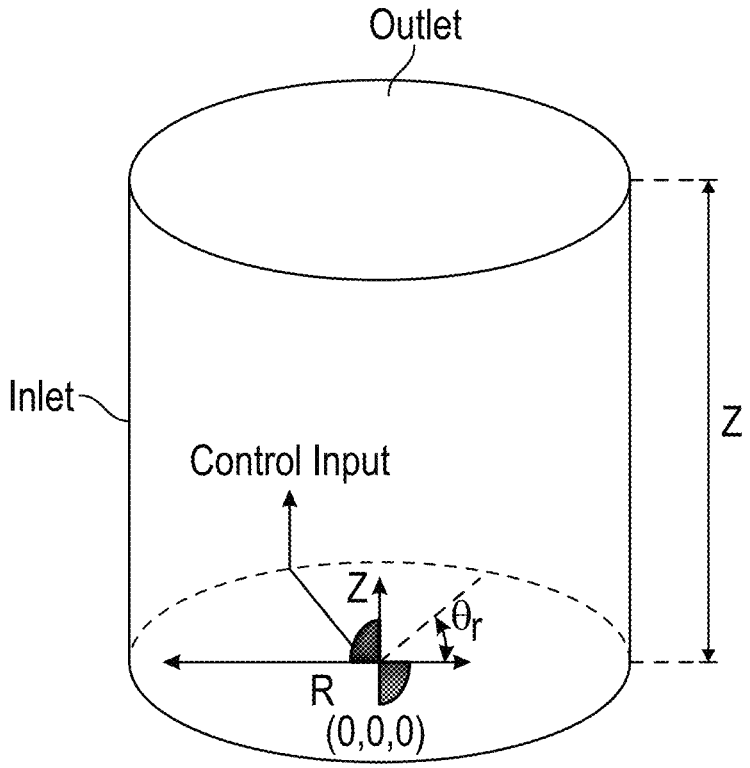
FIG. 6 depicts a computational setup for a vortex model in accordance with one or more embodiments of the disclosure.
Figure 7A:
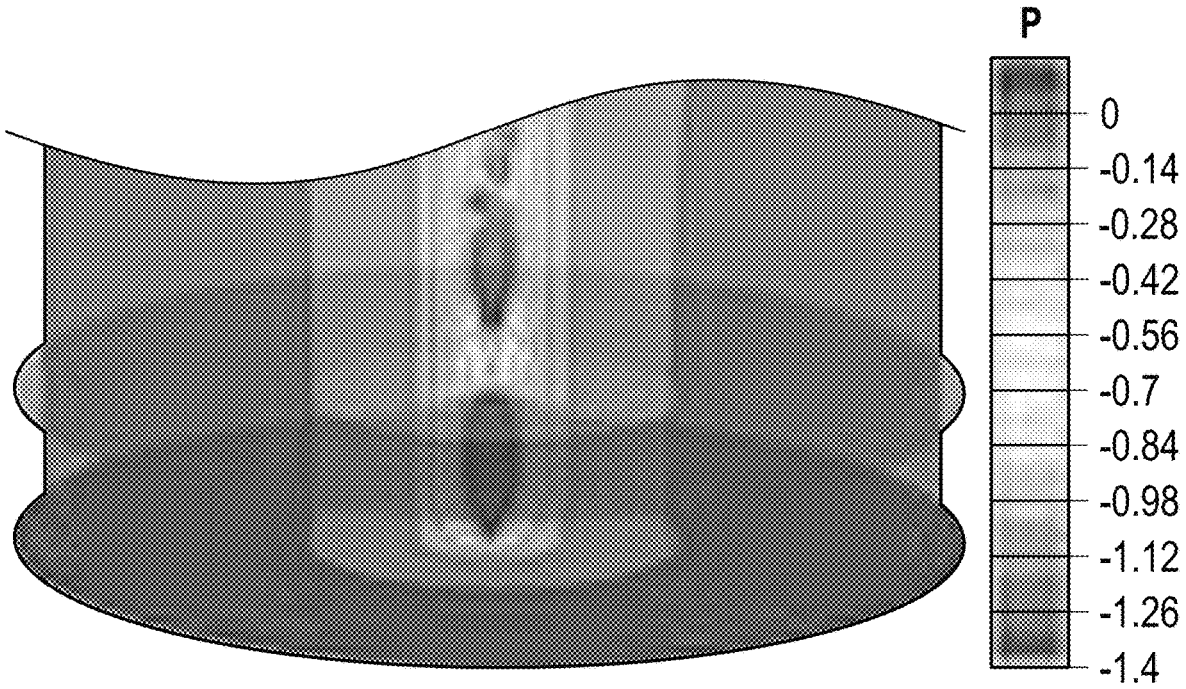
FIGS. 7A to 7D depict a baseline flow field visualization of an instantaneous flow field in accordance with one or more embodiments of the disclosure.
Figure 7B:
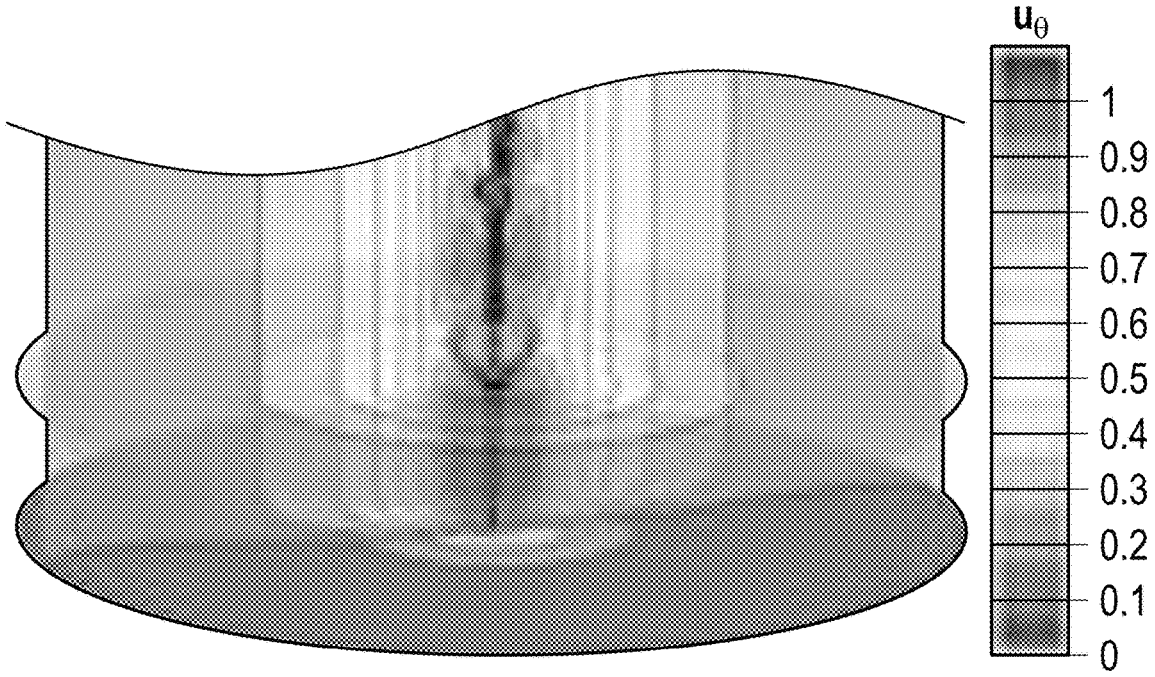
Figure 7C:
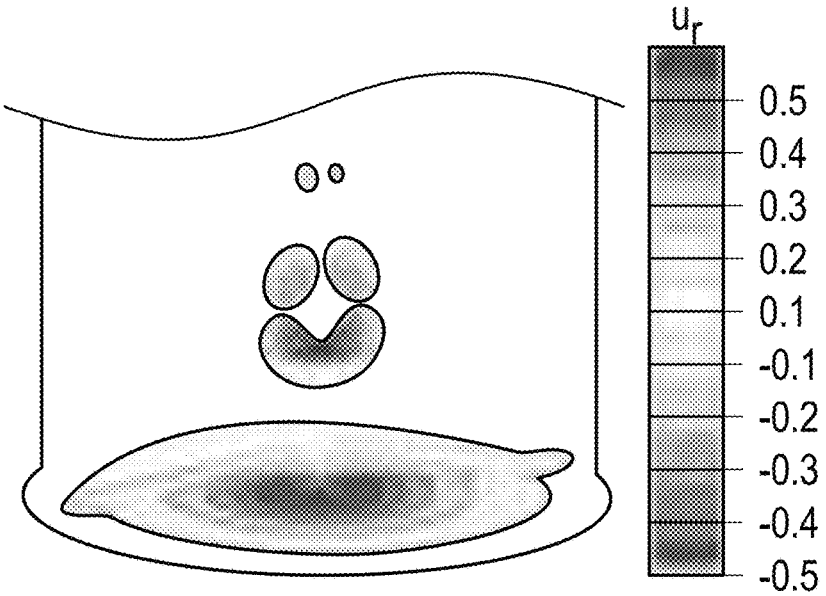
Figure 7D:
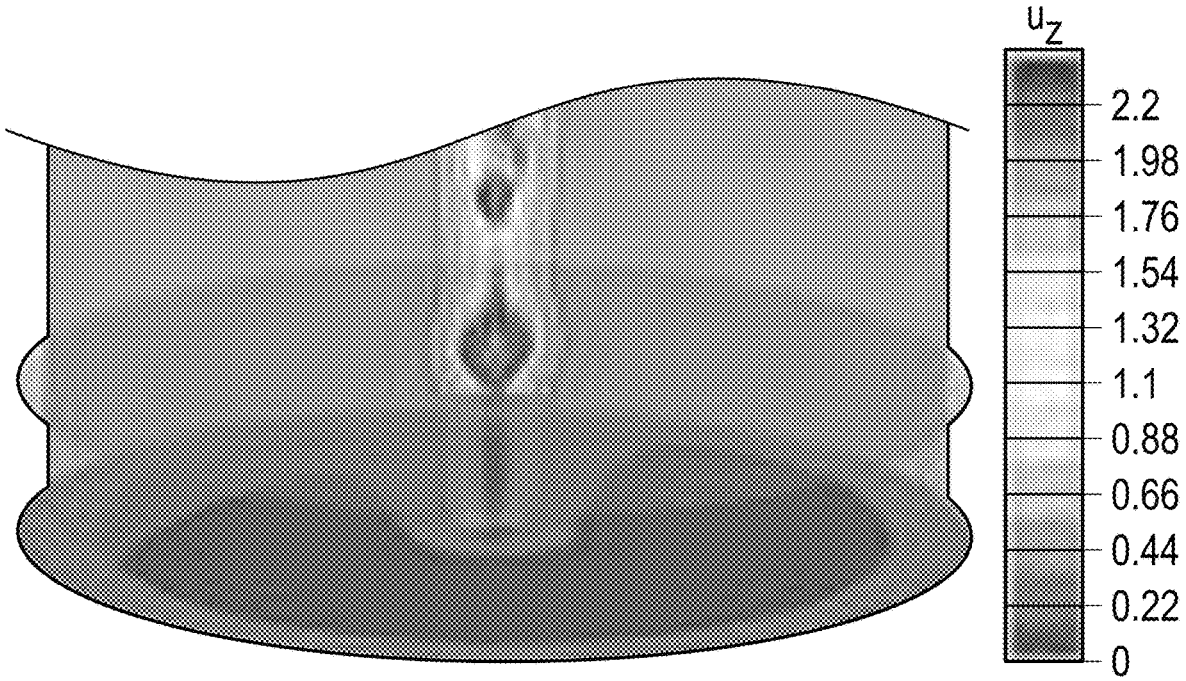

In one example, a submerged vortex model was a modification of Burgers vortex by a no-slip boundary condition along the symmetry plane. As depicted in FIG. 6, a no-slip boundary condition was included along the symmetry plane. To examine the effectiveness of the vortex control device using unsteady mass injection on the lower control region, incompressible 3D direct numerical simulation ("DNS") was performed on the submerged vortex model generated by the Burger vortex velocity profile. In this manner, FIG. 6 depicts the computational setup of a 3-D direct numerical simulation of the submerged vortex model generated by the Burgers vortex-type velocity profile. In this computation, the geometric setup was as follows: r radius $u_r$; θ azimuthal angle $u_\theta$; and z axis $u_z$. The boundary conditions were defined as follows:

Inlet: ($u_r$, $u_\theta$, $u_z$); Outlet:

$$\frac{\partial u}{\partial n} + (u\cdot n)\frac{\partial u_z}{\partial z} = 0;$$

and Bottom: u=0. The control input comprised unsteady mass injection imposed from the lower surface, where $u_s$=A cos(θ+$\omega_c$t)e−$^{r^2}$, where $\omega_e$ is the control frequency, and A is amplitude. The control efforts were evaluated using $$c_\mu = \frac{\rho\infty u_z^2 \mathcal{A}_{act}}{\frac{1}{2}\rho\infty u_{\theta max}^2 \mathcal{A}},\ \mathcal{A} = a_0 z^*;\ z^* = 1\ \text{(axial unit length); and}$$

$$u_z^2 \mathcal{A}_{act} = \frac{1}{T}\int_0^T\int_0^{2\pi}\int_{-\infty}^{+\infty}(u_z)^2\,dr\,d\theta\,dt.$$

Figure 8:
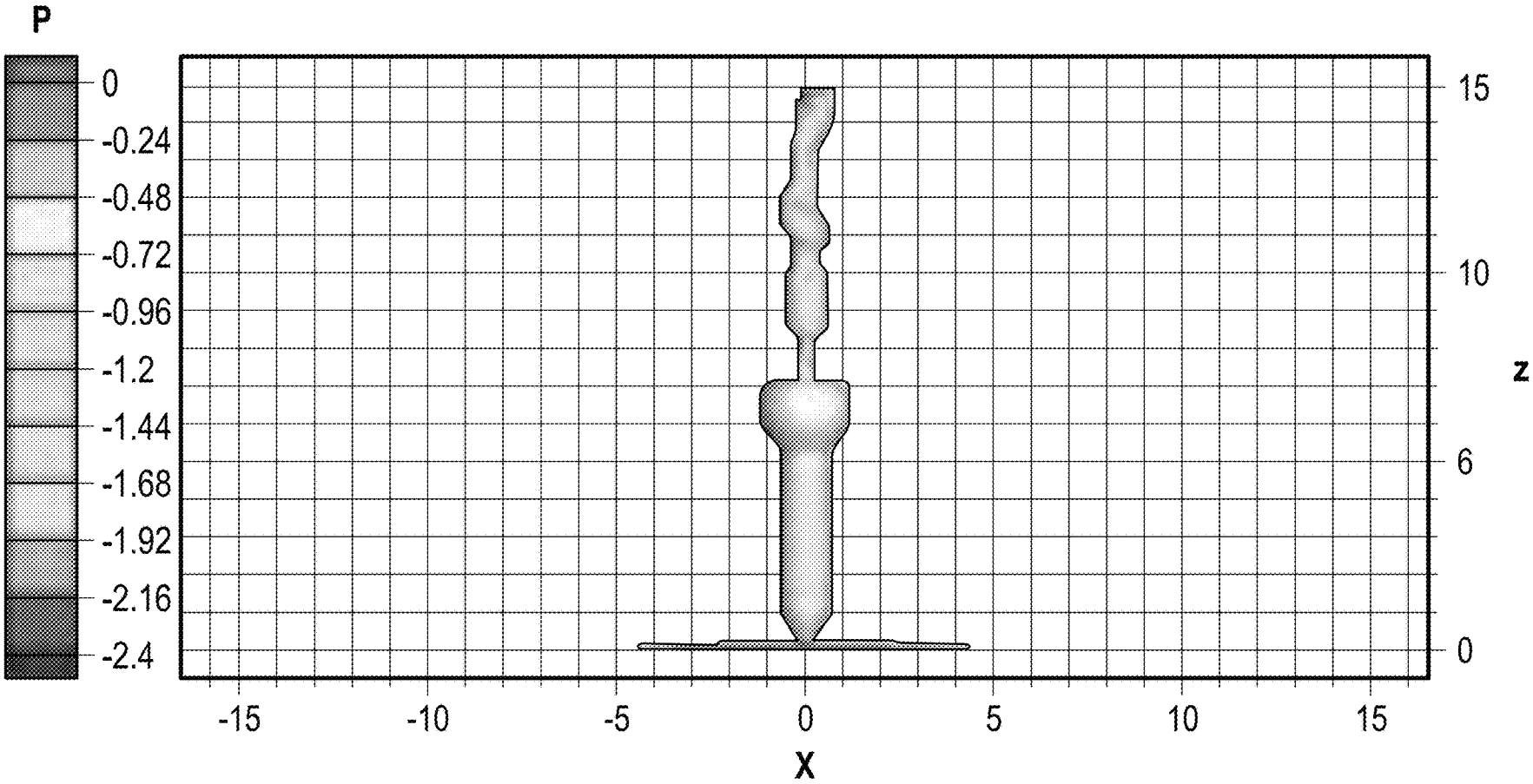
FIG. 8 depicts a baseline flow field visualization of a vortex bursting structure in accordance with one or more embodiments of the disclosure.

FIGS. 7A-7D and FIG. 8 depict a baseline flow field visualization of the computational setup. FIGS. 7A to 7D depict the instantaneous flow field of the computational setup, and FIG. 8 depicts the vortex bursting structure of the computational setup.

Mass Injection

Figure 9:
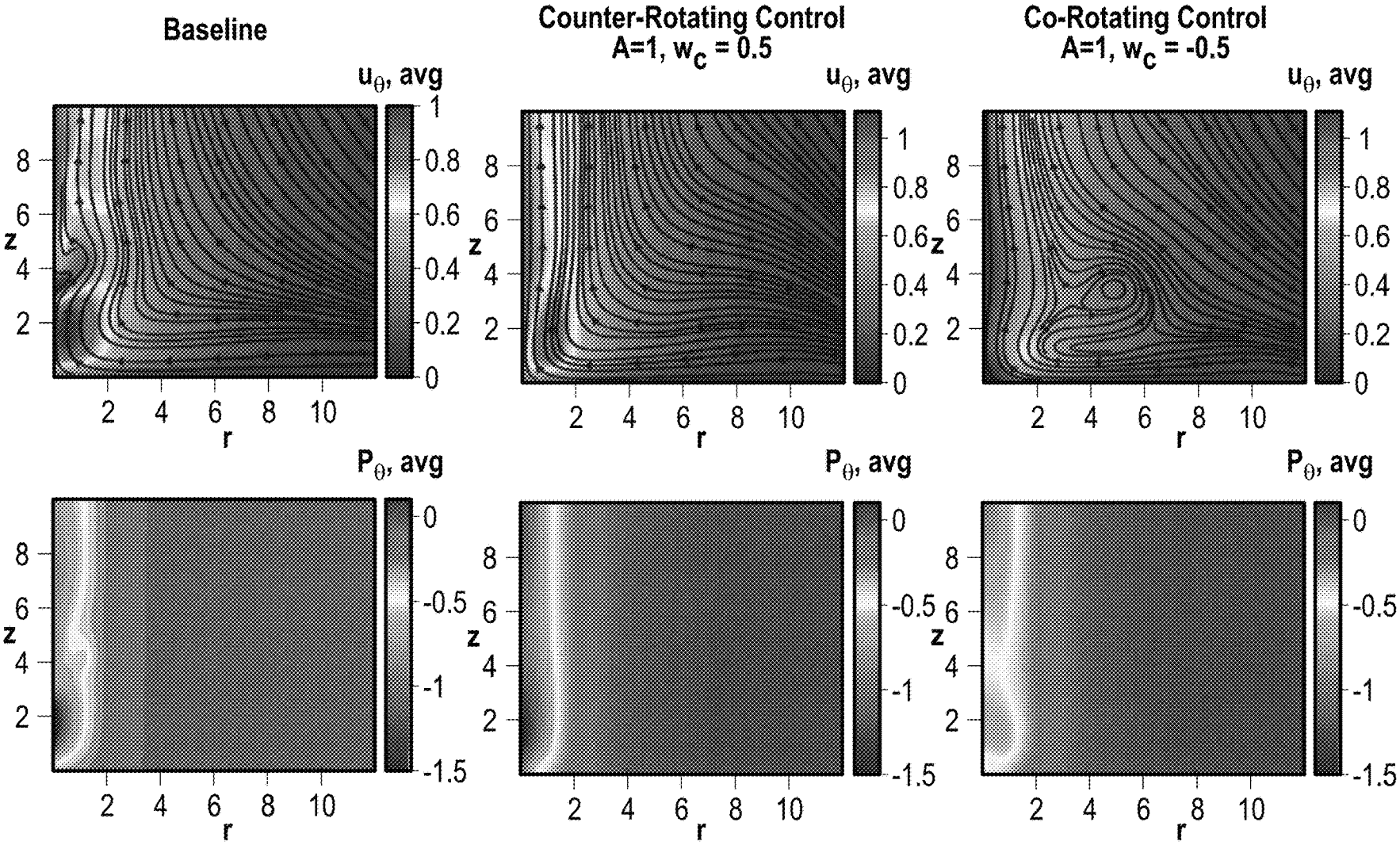
FIG. 9 depicts the control effect of counter- and co-rotating mass injection in accordance with one or more embodiments of the disclosure.
Figure 10:
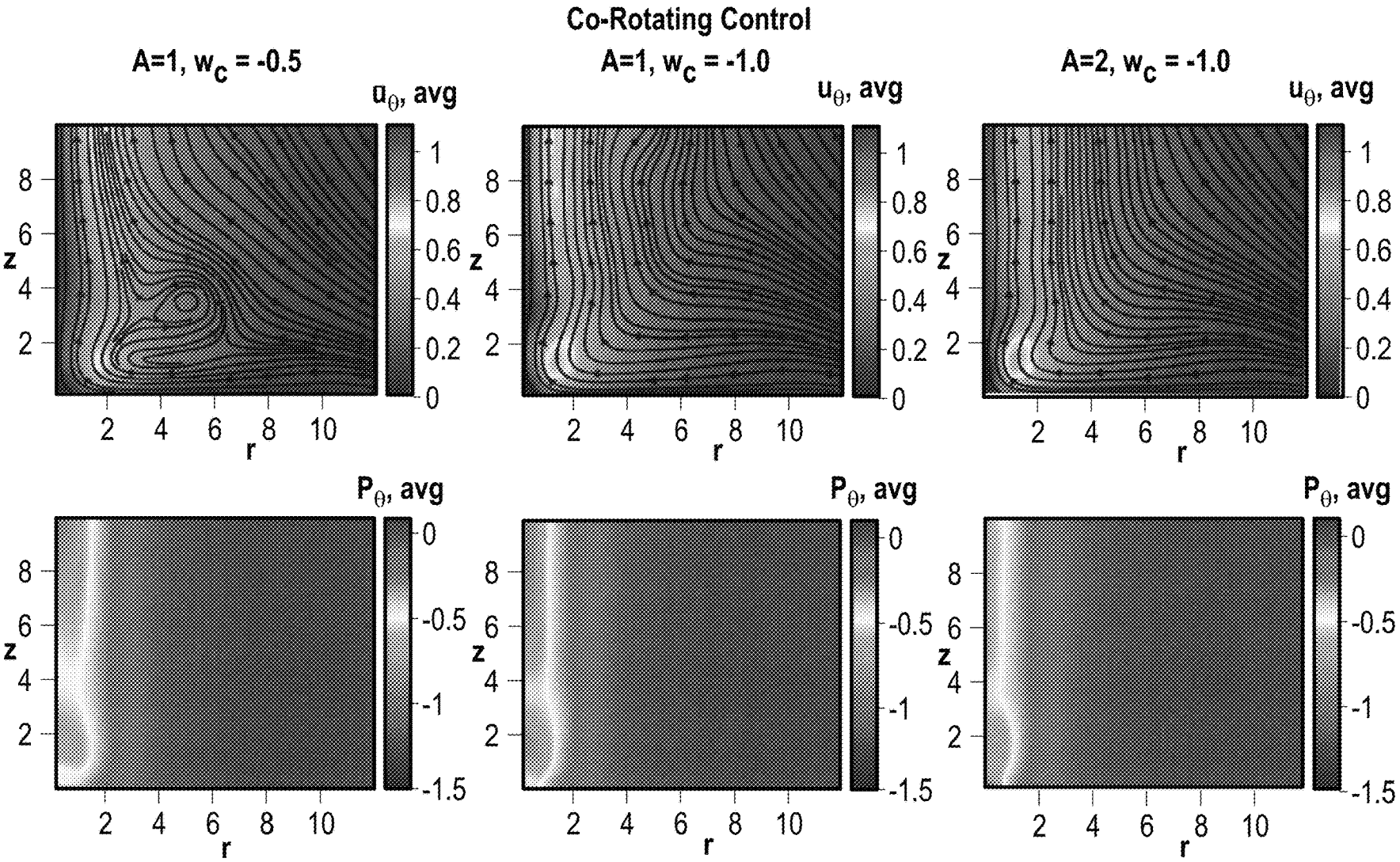
FIG. 10 depicts the control effect of co-rotating mass injection in accordance with one or more embodiments of the disclosure.
Figure 11A:
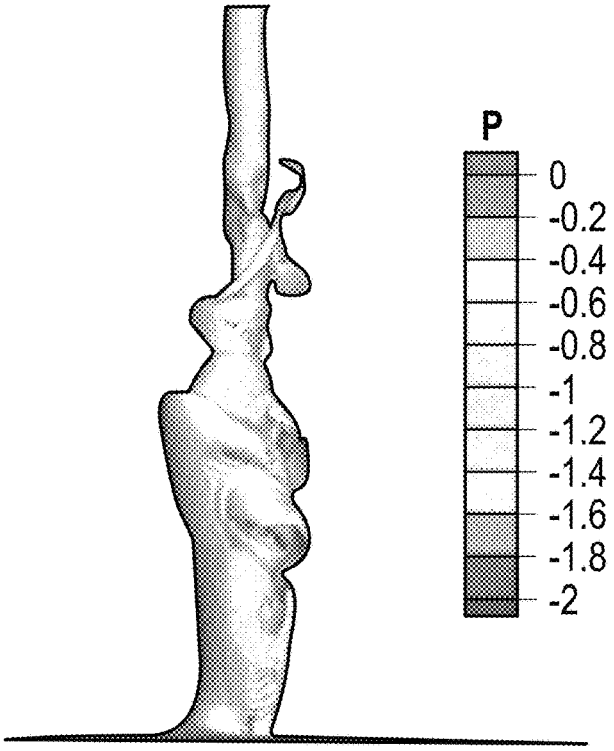
FIG. 11A depicts the control effect of co-rotating mass injection in accordance with one or more embodiments of the disclosure.
Figure 11B:
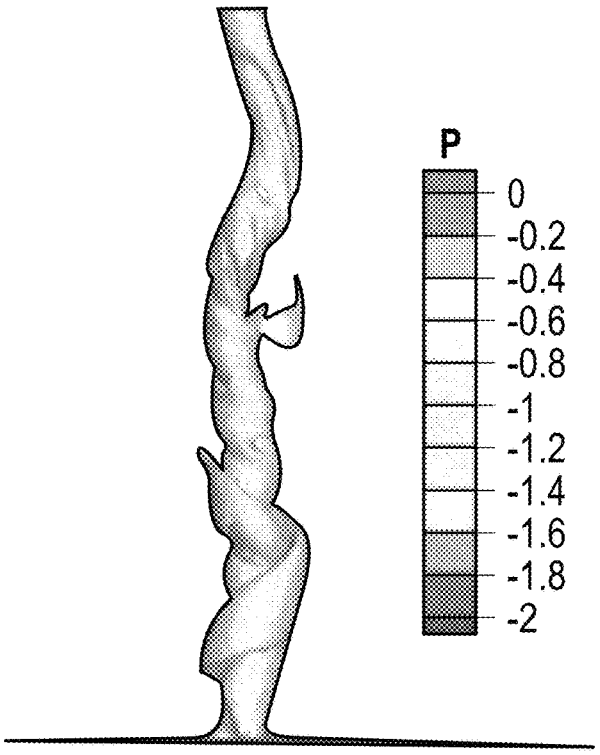
FIG. 11B depicts the control effect of counter-rotating mass injection in accordance with one or more embodiments of the disclosure.

The vortex control devices disclosed herein provide effective unsteady forcing for single-phase vortex modification. Co-rotating and counter-rotating forcing can excite vortex wake and instability, respectively. In the co-rotating vortex control case, as depicted in FIGS. 9 and 11A, the core pressure tends to be more uniform at the near-wall region. The low-pressure region enlarges but with increased pressure along the vortex core axis and modifies the vortex behavior. In the co-rotating mass injection control, as depicted in FIG. 11A, the toroidal structure encloses the columnar vortex, splits to the thinner vortex rings, and sweeps upward. On the other hand, in the counter-rotating vortex control case, as depicted in FIGS. 10 and 11B, the low-core pressure increases immediately at the lower core region, the vortex diffuses, and small-scale helical vertical structures are stripped from the controlled vortex taking advantage of the hydrodynamic instabilities. As depicted in FIG. 13B, during counter-rotating control, the columnar vortex exhibits a waving structure, which is no longer vertical, especially in the higher region. A number of small-scale short wavelength helical waves are stripped from the columnar vortex and diffuse. Both co-rotating and counter-rotating forcing techniques successfully increased the time-average core pressure of the vortex.

As depicted in FIGS. 9, 10, and A-11B, the two different control approaches include mass injection/suction variation over time in a rotational manner. The overall concept is applicable not only to a sump pump but also to wall-normal vortices in general, which appear in a wide range of engineering and natural fluid flow settings.

Off-Centered Vortex Control

Figure 12:
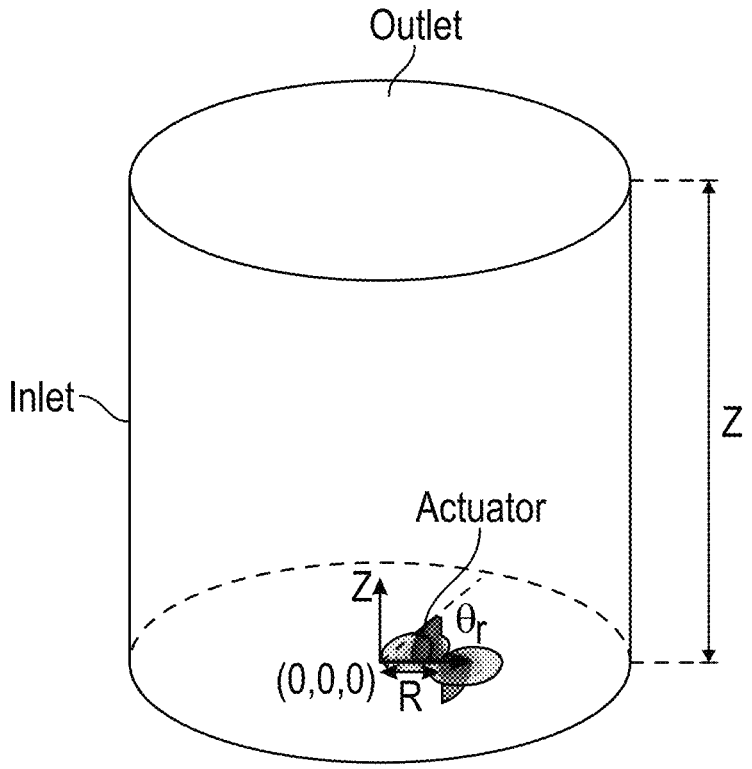
FIG. 12 depicts a computational setup for a vortex model with an off-centered control device in accordance with one or more embodiments of the disclosure.

The robustness of the vortex control was evaluated using an off-centered approach. That is, the vortex control device was disposed off-center from the core of the vortex. As depicted in FIG. 12, actuation input was placed R away from the baseline vortex center. R was normalized by the vortex core radius. Both co-rotating and counter-rotating control inputs were examined. In particular, the robustness of the control to increase core pressure was examined via numerical simulation. As depicted in Table 1, six simulations were conducted with off-center control inputs.

TABLE 1

| | Co-rotation | Counter-rotation |
|---|---|---|
| R | 1 | 1 |
| | 2 | 2 |
| | 3 | 3 |

Figure 13A:
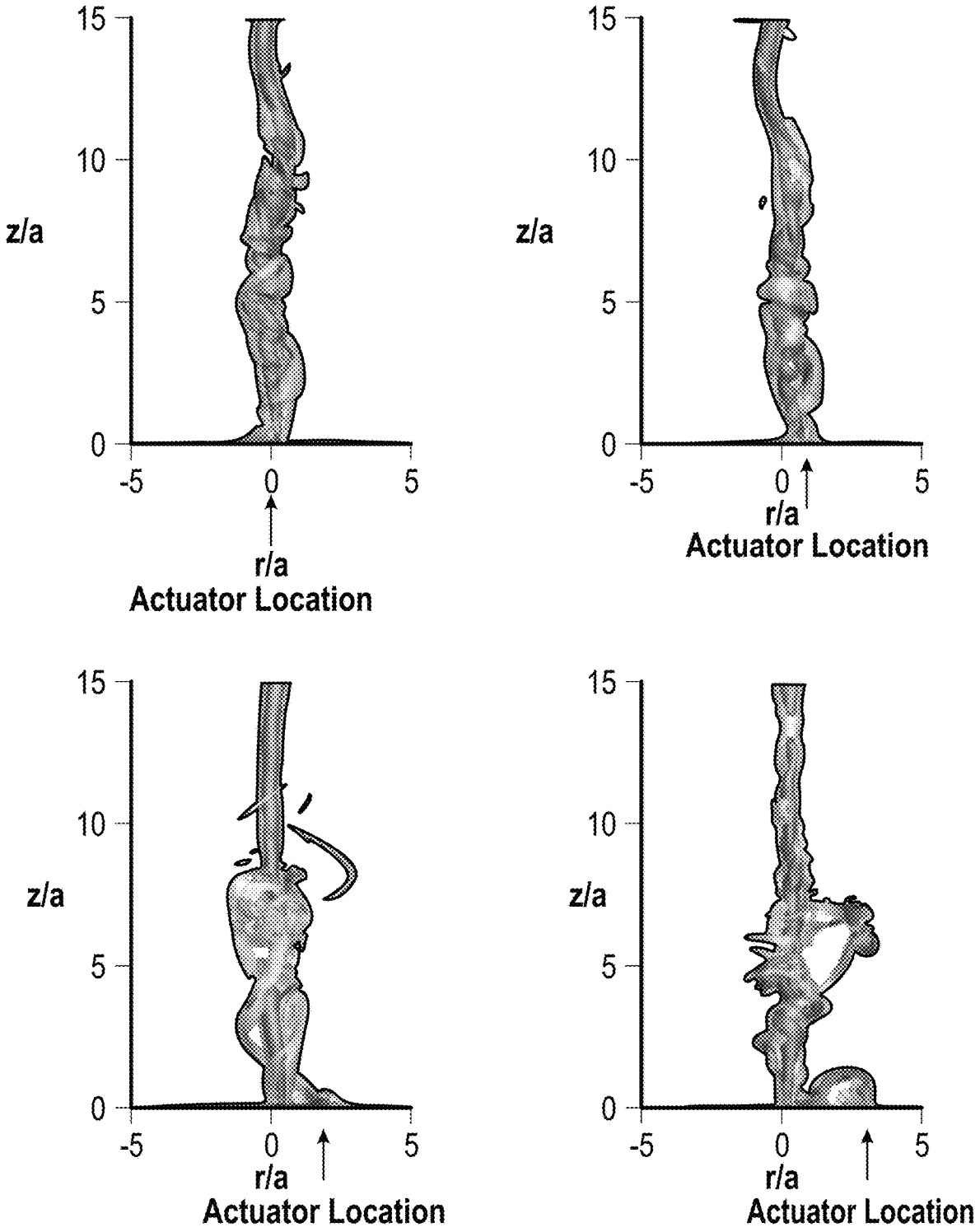
FIG. 13A depicts the location of the control device in a counter-rotating simulation in accordance with one or more embodiments of the disclosure.
Figure 13B:
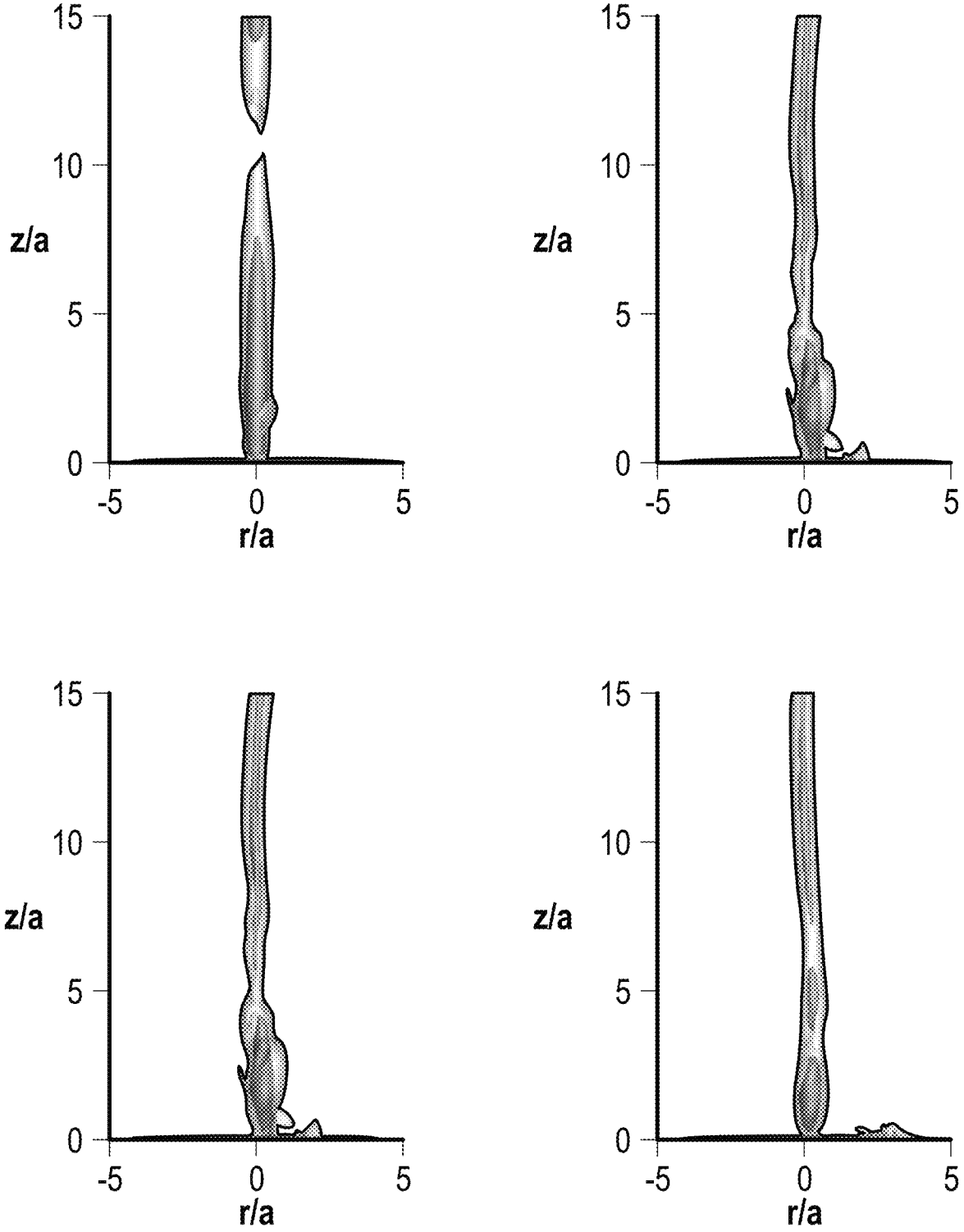
FIG. 13B depicts the time averaged flow fields for the counter-rotating simulation in FIG. 13A in accordance with one or more embodiments of the disclosure.

The arrow in FIG. 13A indicates the location of the control device in a counter-rotating simulation. In this simulation, A=1; $f_c$=0.08; Q-criterion=2 and $\|\omega\|$=2. FIG. 13B depicts the corresponding time averaged flow fields for the counter-rotating simulation in FIG. 13A. Table 2 depicts the time-averaged vortex core pressure distributions along the axial direction for co-rotating and counter-rotating simulations, where $$P_{increase}\ \% = \frac{P^{a}_{avg,min} - P^{b}_{avg,min}}{P^{b}_{avg,\min}}.$$

TABLE 2

| | Co-rotating | | Counter-rotating | |
|---|---|---|---|---|
| | $p_{avg,min}$ | $p_{increase}$ % | $p_{avg,min}$ | $p_{increase}$ % |
| R = 0 | −1.397 | 59.02% | −2.098 | 38.48% |
| R = 1 | −2.503 | 26.59% | −1.699 | 50.16% |
| R-2 | −1.242 | 63.58% | −2.141 | 37.23% |
| R-3 | −1.826 | 46.45% | −1.523 | 55.33% |
| Baseline | −3.410 | — | −3.410 | — |

Figure 14A:
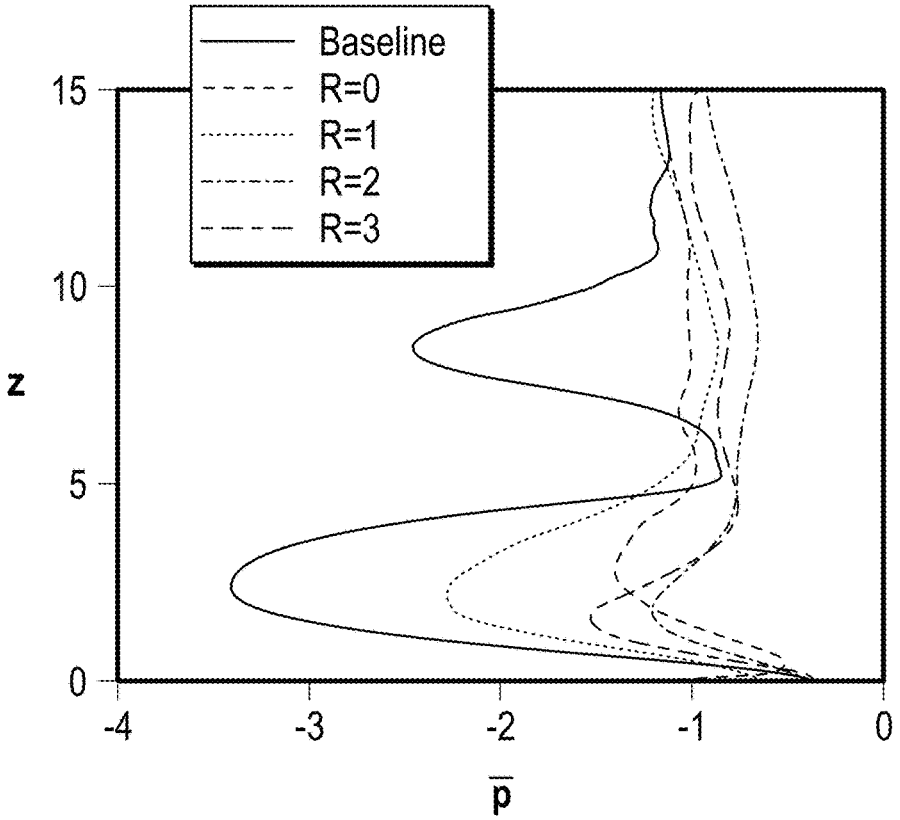
FIG. 14A depicts the time-averaged vortex core pressure distributions along the axial direction for co-rotating simulations in accordance with one or more embodiments of the disclosure.
Figure 14B:
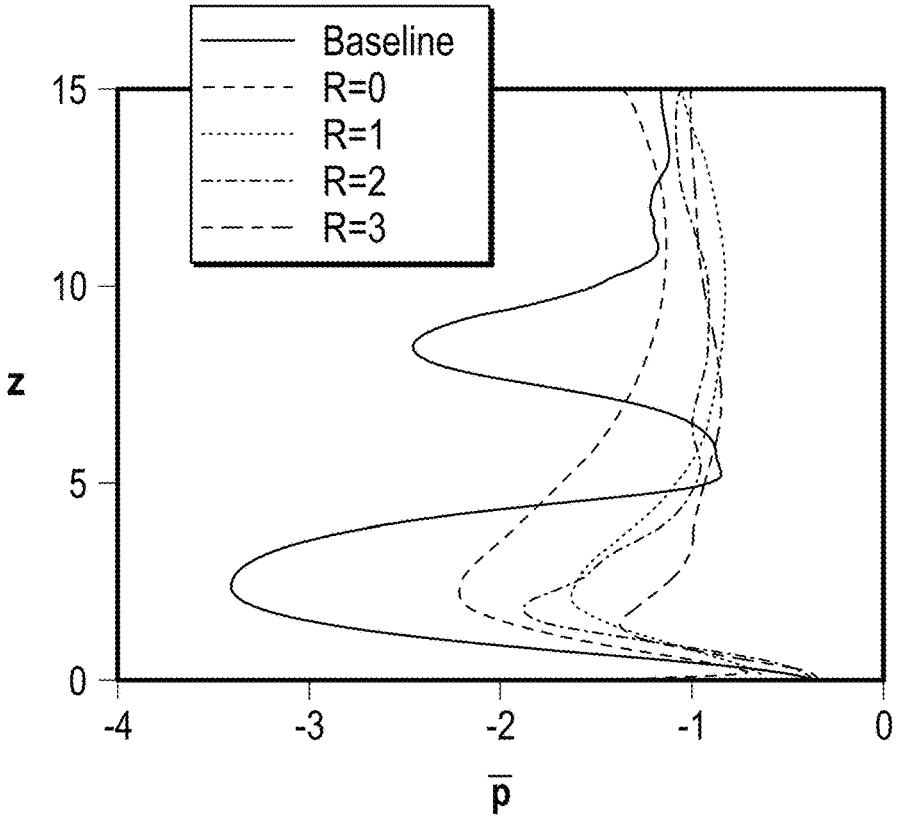
FIG. 14B depicts the time-averaged vortex core pressure distributions along the axial direction for counter-rotating simulations in accordance with one or more embodiments of the disclosure.

FIG. 14A depicts the time-averaged vortex core pressure distributions along the axial direction for co-rotating simulations, and FIG. 14B depicts the time-averaged vortex core pressure distributions along the axial direction for counter-rotating simulations. The control robustness has been assessed by shifting the action away from the core vortex. Both co-rotation and counter-rotation off-centered control attained significant vortex core pressure increases. The off-centered control setup confirms the robustness of the vortex pressure increase device discussed above.

The disclosed device/technique enables the modification of the vortex and alleviates the low-pressure core by introducing active mass injection/suction at ports on the surface in a circulation arrangement around the vortex core (e.g., centered and off-center). The blowing direction can be tuned but in general is oriented in a normal manner to the surface. Suction is also introduced with injection at different ports but at the same time. The strengths of injection and suction changes in time along the ports along their circular arrangement. The device can introduce mass injection and suction in a co-rotating or counter-rotating manner with respect to the wall-normal vortex.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

We claim:

1. A vortex control device for modifying a vortex in a fluid stemming from a wall, the device comprising:

a rotatable hub disposed within an opening in the wall; and an inlet port and an outlet port in the rotatable hub, wherein the inlet port forms a suction port which is configured to suction the fluid from or about the vortex, wherein the outlet port forms an injection port which is configured to inject the fluid into or about the vortex, and wherein the suctioning and the injecting of the fluid is effective to disrupt the vortex.

2. The device of claim 1, wherein a surface of the hub is flush with a surface of the wall.

3. The device of claim 1, wherein the inlet port and the outlet port are located at or near a core of the vortex.

4. The device of claim 1, wherein the inlet port and the outlet port are disposed around a perimeter of the vortex.

5. The device of claim 1, wherein the hub is configured to co-rotate with the vortex.

6. The device of claim 1, wherein the hub is configured to counter-rotate with the vortex.

7. The device of claim 1, wherein the inlet port is configured to suction fluid from or about the vortex at the same time that the outlet port is configured to inject fluid into or about the vortex.

8. The device of claim 1, wherein an angle, rotation speed/direction, and blowing/suction rate of the inlet port and the outlet port are controllable.

9. The device of claim 1, further comprising a pump in fluid communication with the hub.

10. The device of claim 9, further comprising a valve configured to control a mass flow of the fluid from the inlet port and to the outlet port.

11. The device of claim 1, which is configured to be off-set from a vortex core of the vortex.

12. A method of disrupting a vortex in a fluid, the method comprising:

rotating a location of an inlet of a suction port about the vortex;

rotating a location of an outlet of an injection port about the vortex;

suctioning the fluid from or about the vortex; and injecting the fluid into or about the vortex, wherein the suctioning and the injecting of the fluid are effective to disrupt the vortex.

13. The method of claim 12, wherein the location of the suction port and injection port co-rotate with the vortex.

14. The method of claim 12, wherein the location of the suction port and injection port counter-rotate with the vortex.

15. The method of claim 12, wherein the fluid comprises water in a sump basin.

16. The method of claim 12, further comprising offsetting a control device from a vortex core of the vortex.

17. A method for modifying a vortex in a fluid, the method comprising:

rotating a suction port and an injection port about the vortex;

suctioning the fluid from or about the vortex; and injecting the fluid into or about the vortex.

18. The method of claim 17, wherein the suction port and the injection port co-rotate with the vortex or counter-rotate with the vortex.

19. The method of claim 17, further comprising:

rotating a location of an inlet of the suction port about the vortex; and rotating a location of an outlet of the injection port about the vortex.

* * * * *